US008979475B2

(12) United States Patent
Lee

(10) Patent No.: US 8,979,475 B2
(45) Date of Patent: Mar. 17, 2015

(54) TURBINE FUEL PUMP FOR VEHICLE

(75) Inventor: Hyuntae Lee, Chungcheongnam-do (KR)

(73) Assignee: Coavis, Chungnam (KR)

( * ) Notice: Subject to any disclaimer, the term of this patent is extended or adjusted under 35 U.S.C. 154(b) by 581 days.

(21) Appl. No.: 13/438,341

(22) Filed: Apr. 3, 2012

(65) Prior Publication Data

US 2012/0257956 A1 Oct. 11, 2012

(30) Foreign Application Priority Data

Apr. 5, 2011 (KR) ..... 10-2011-0030994

(51) Int. Cl.

| | |
|---|---|
| ***F04D 29/40*** | (2006.01) |
| ***F02M 37/04*** | (2006.01) |
| ***F04D 5/00*** | (2006.01) |
| ***F04D 29/18*** | (2006.01) |

(52) U.S. Cl.

CPC ..... *F02M 37/048* (2013.01); *F04D 5/008* (2013.01); *F04D 29/188* (2013.01)

USPC ..... 415/55.1

(58) Field of Classification Search

CPC ..... F04D 29/188; F04D 5/002; F04D 5/007; F04D 5/005; F04D 5/008; F02M 37/048

USPC ..... 415/55.1–55.7; 417/423.4; 123/497

See application file for complete search history.

(56) References Cited

U.S. PATENT DOCUMENTS

| | | | | |
|---|---|---|---|---|
| 4,556,363 | A * | 12/1985 | Watanabe et al. | 415/55.6 |
| 4,692,092 | A * | 9/1987 | Matsuda et al. | 415/143 |
| 4,784,587 | A * | 11/1988 | Takei et al. | 417/423.6 |
| 5,472,321 | A * | 12/1995 | Radermacher | 417/365 |
| 5,980,200 | A * | 11/1999 | Rollwage et al. | 415/55.1 |
| 6,179,579 | B1 * | 1/2001 | Dobler et al. | 417/356 |
| 6,443,693 | B1 * | 9/2002 | Eck | 415/55.1 |
| 2005/0249581 | A1 * | 11/2005 | Yu et al. | 415/55.1 |

FOREIGN PATENT DOCUMENTS

JP 01104998 A * 4/1989

* cited by examiner

*Primary Examiner* — Nathaniel Wiehe
*Assistant Examiner* — Eldon Brockman
(74) *Attorney, Agent, or Firm* — The Webb Law Firm

(57) ABSTRACT

Provided is a turbine fuel pump for a vehicle. More particularly, provided is a turbine fuel pump for a vehicle that can improve efficiency of the fuel pump and solve pressure instability caused by collision of fuel by forming a separate independent channel in a lower casing, an impeller, and an upper casing where channels of fuel are formed at the time of suctioning fuel from the fuel tank and supplying fuel to an engine of an internal combustion engine.

2 Claims, 4 Drawing Sheets

TURBINE FUEL PUMP FOR VEHICLE

CROSS-REFERENCE TO RELATED APPLICATIONS

This application claims priority under 35 U.S.C. §119 to Korean Patent Application No. 10-2011-0030994, filed on 5 Apr. 2011, in the Korean Intellectual Property Office, the disclosure of which is incorporated herein by reference in its entirety.

TECHNICAL FIELD

The following disclosure relates to a turbine fuel pump for a vehicle. More particularly, the following disclosure relates to a turbine fuel pump for a vehicle that can improve efficiency of the fuel pump and solve pressure instability caused by collision of fuel by forming a separate independent channel in a lower casing, an impeller, and an upper casing where channels of fuel are formed at the time of suctioning fuel from the fuel tank and supplying fuel to an engine of an internal combustion engine.

BACKGROUND

In general, a fuel pump of a vehicle is mounted on the inside of a fuel tank of the vehicle and serves to suction fuel and pressure-feed the suctioned fuel to a fuel injection device mounted in an engine.

In addition, the fuel pump for the vehicle is classified into a mechanical fuel pump and an electrical fuel pump and a turbine fuel pump 10 which is a type of electrical fuel pump is primarily used in an engine using gasoline as fuel.

In the turbine fuel pump 10, a driving motor 20 is provided in a motor housing 60 of the fuel pump 10, an upper casing 30 and a lower casing 40 are provided on a lower end part of the motor housing 60 to be closely attached to each other, and an impeller 50 is interposed therebetween as shown in FIG. 1.

In addition, the impeller 50 is joined to a rotational shaft 21 of a driving motor 20, such that the impeller 50 is configured to rotate with the driving motor 20.

That is, as the impeller 50 rotates, a pressure difference is generated, and as a result, fuel is suctioned into the impeller 50 and while the pressure of fuel is increased by a rotation flow generated by continuous rotation of the impeller 50, fuel is discharged.

Therefore, fuel is introduced into a fuel suction port 41 of the lower casing 40 to flow to a check valve 70 formed in an upper part of the motor housing 60 along an inner part of the motor housing 60 through a fuel discharge port 31 of the upper casing 30 with the pressure thereof increased through the rotating impeller 50 and supplied to the fuel injection device mounted on the engine of the vehicle.

In this case, the impeller 50 is formed in a disk shape, a plurality of blades 51 are formed on an circumferential surface thereof in an outer direction of the circumferential surface, blade chambers 52 are formed among respective blades 51 to penetrate through both surfaces of the impeller 50 as shown in FIG. 2, such that fuel is introduced and discharged individually in an upper part and a lower part of the blade chamber 52 and fuel is introduced into the fuel suction port 41 of the lower casing 40 to generate the rotation flow in a space between a blade chamber 52 and a lower channel groove 42 formed in the lower casing 40 and an upper channel groove 32 formed in the upper casing 30 as shown in FIG. 3, and a circulation process in which fuel is again introduced into the neighboring blade chamber 52 to generate the rotation flow is repeated. Therefore, kinetic energy generated by the rotation of the impeller 50 is converted into pressure energy of fuel, and as a result, fuel is delivered to the fuel discharge port 31 of the upper casing 30.

In addition, in the impeller 50 in the related art, a circumference center guide 53 is formed at the center of the circumferential surface along the circumferential surface of the impeller 50 so as to efficiently generate the rotation flow formed in the space between the blade chamber 52 and the lower channel groove 42 and the rotation flow generated in the space between the impeller chamber 52 and the upper channel groove 32.

In this case, as shown in FIG. 4, the fuel that flows along the upper channel groove 32 of the upper casing 30 is discharged through the fuel discharge port 31. However, the fuel that flows along the lower channel groove 42 of the lower casing 40 should be discharged through the fuel discharge port 31 by passing through the blade chamber 52 of the impeller 50.

Therefore, the fuel that flows along the lower channel groove 42 hits the blade 51 of the impeller 50 and passes through the blade chamber 51 to interrupt the flow of the rotation flow, thereby causing loss of a fuel movement amount and further, serve as flow resistance of fuel to make the pressure of the fuel pump instable and deteriorate performance.

Further, with a current technological tendency in which components in the vehicle are gradually subjected to a light weight, a compact size, and high performance in order to satisfy user's various preferences globally, a study about high performance of even the fuel pump has been required.

In addition, performance of the fuel pump is determined according to a specification of the vehicle and high efficiency is required as a recent trend. Therefore, the turbine fuel pump for a vehicle in the related art is limitative in increasing a discharge amount of fuel under high pressure.

SUMMARY

An embodiment of the present invention is directed to providing a turbine fuel pump for a vehicle that can improve efficiency of the fuel pump by allowing fuel to pass through a separate independent channel without passing through an impeller blade and solve pressure instability by reducing flow resistance caused by collision of fuel by forming the separate independent channel in a lower casing, an impeller, and an upper casing where channels of fuel are formed.

In one general aspect, a turbine fuel pump for a vehicle includes: an upper casing 100 including an upper channel groove 120 formed in a lower surface thereof so as to allow fuel to flow therethrough and a fuel discharge port 110 connected to the upper channel groove 120, formed to penetrate through upper and lower surfaces thereof, and discharging the fuel therethrough; a lower casing 300 joined to a lower part of the upper casing 100 and including a lower channel groove 320 formed in an upper surface thereof so as to allow the fuel to flow therethrough and a fuel suction port 310 connected to the lower channel groove 320, formed to penetrate through upper and lower surfaces thereof, and introducing the fuel thereinto; and an impeller 200 provided between the upper casing 100 and the lower casing 300, having a disk shape, and including a plurality of blades 230 formed along an outer circumferential surface in an outer direction of the outer circumferential surface and blade chambers 240 each formed between the blades 230 so as to penetrate through upper and lower surfaces thereof to allow the fuel to be discharged and introduced in upper and lower parts of the blades 230, respectively, wherein the upper casing 100 includes an upper inner channel 140 formed to be spaced apart from a shaft penetration hole 130 formed at the center thereof by a predetermined distance and penetrate through the upper and lower surfaces thereof, the impeller 200 includes an impeller channel 260 formed to be spaced apart from a shaft fixation hole 220 formed at the center thereof by a predetermined distance and penetrate through the upper and lower surfaces thereof, and the lower casing 300 includes a lower inner channel 340 formed at the center of the upper surface thereof and a lower connection groove 350 connecting the lower inner channel 340 and the lower channel groove 320 to each other, such that a separate channel is formed so that the fuel suctioned into the fuel suction port 310 flows along the lower channel groove 320 by rotation of the impeller 200, is introduced into the lower inner channel 340 through the lower connection groove 350, and passes through the impeller channel 260 to be discharged through the upper inner channel 140.

Further, one side of the lower connection groove 350 may be connected to the lower inner channel 340 and the other side thereof may be connected to the lower channel groove 320 and one side of the lower connection groove 350 may be connected to an opposite end of the lower channel groove 320 connected to the fuel suction port 310.

Other features and aspects will be apparent from the following detailed description, the drawings, and the claims.

DETAILED DESCRIPTION OF MAIN ELEMENTS

Figure 1:
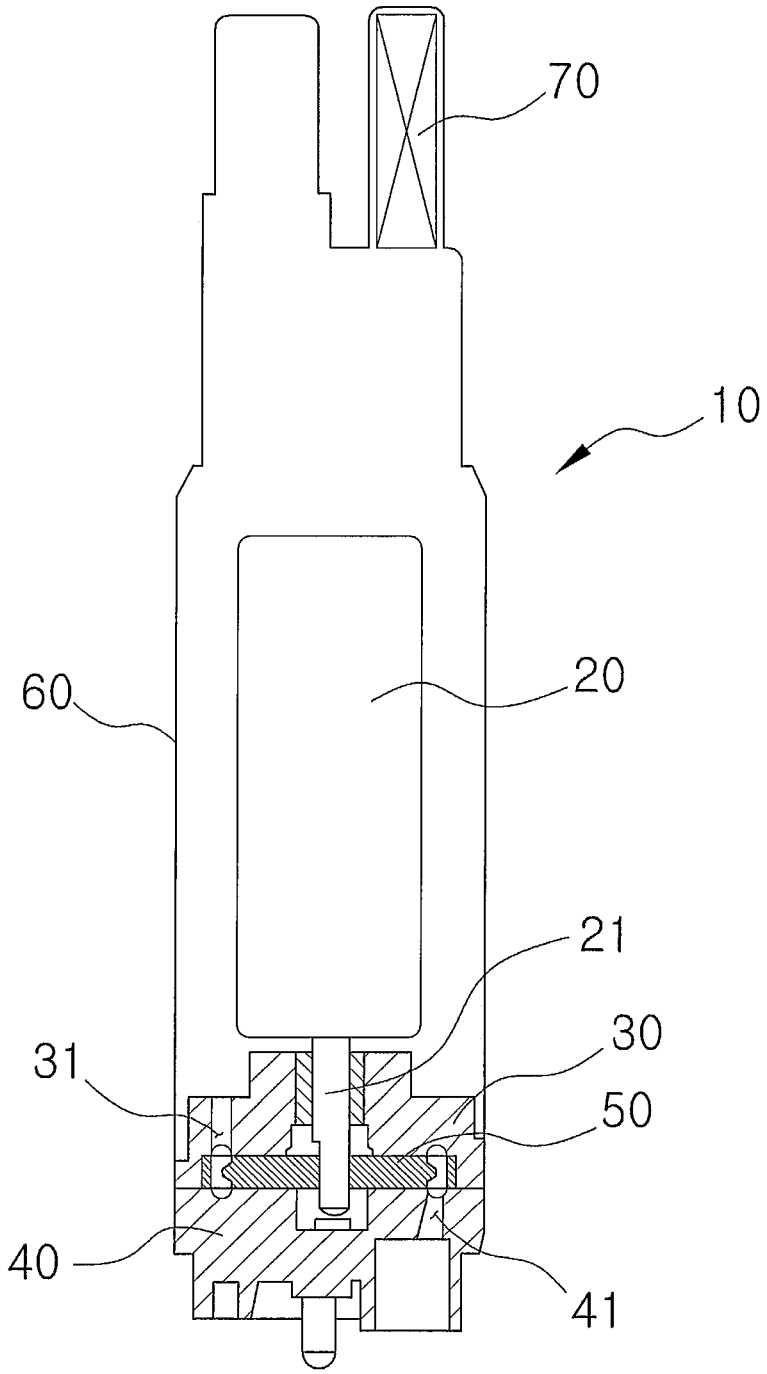
FIG. 1 is a cross-sectional view illustrating a schematic configuration of a turbine fuel pump for a vehicle in the related art.
Figure 2:
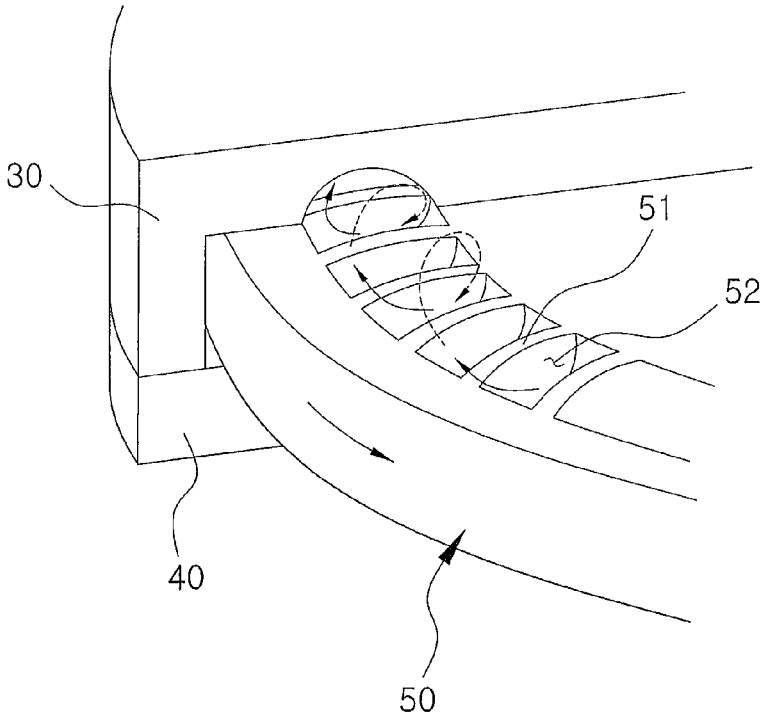
FIG. 2 is a perspective view illustrating an impeller in the related art.
Figure 3:
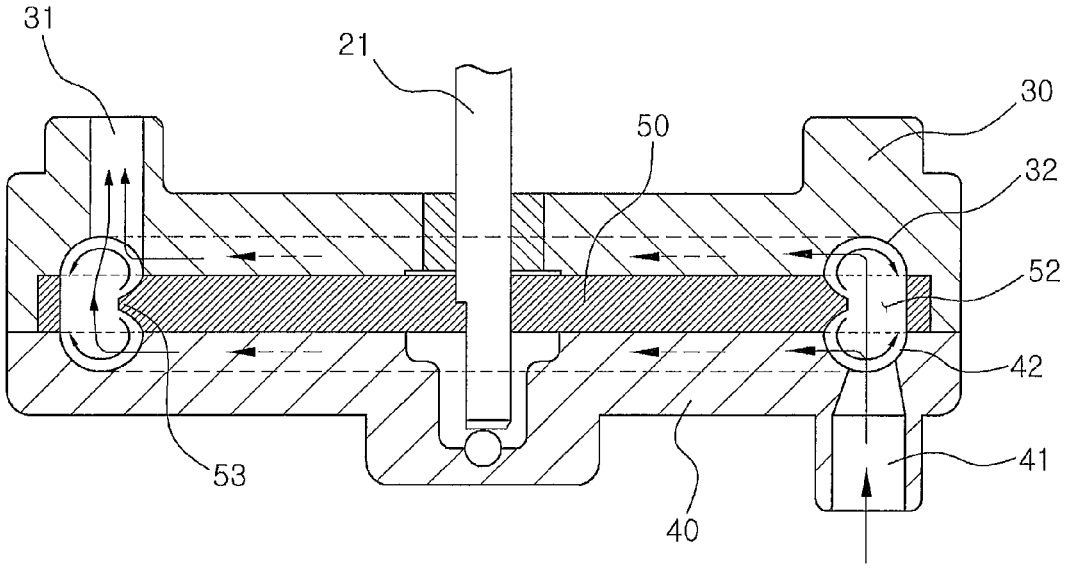
FIG. 3 is a cross-sectional view illustrating a flow of fuel in the fuel pump in the related art.
Figure 4:
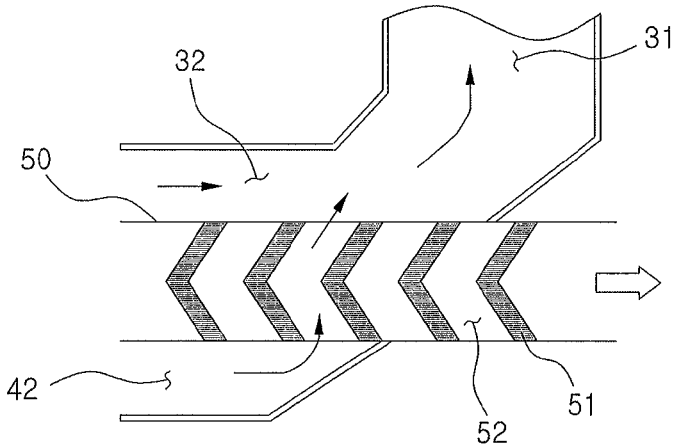
FIG. 4 is a schematic diagram illustrating the flow of fuel at a fuel outflow portion of the fuel pump in the related art.

10: Fuel pump
20: Motor
21: Rotational shaft
30: Upper casing
31: Fuel discharging port
32: Upper channel groove
40: Lower casing
41: Fuel suction port
42: Lower channel groove
50: Impeller
51: Blade
52: Blade chamber
53: Circumference center guider
60: Motor housing
70: Check valve
1000: Turbine fuel pump for vehicle (present invention)
100: Upper casing
110: Fuel discharge port
120: Upper channel groove
130: Shaft penetration hole
140: Upper inner channel
200: Impeller
210: Impeller body
220: Shaft fixation hole
230: Blade
240: Blade chamber
250: Side ring
260: Impeller channel
300: Lower casing
310: Fuel suction port
320: Lower channel groove
330: Shaft support groove
340: Lower inner channel
350: Lower connection groove
360: Ball

DETAILED DESCRIPTION OF EMBODIMENTS

A turbine fuel pump for a vehicle includes: an upper casing 100 including an upper channel groove 120 formed in a lower surface thereof so as to allow fuel to flow therethrough and a fuel discharge port 110 connected to the upper channel groove 120, formed to penetrate through upper and lower surfaces thereof, and discharging the fuel therethrough; a lower casing 300 joined to a lower part of the upper casing 100 and including a lower channel groove 320 formed in an upper surface thereof so as to allow the fuel to flow therethrough and a fuel suction port 310 connected to the lower channel groove 320, formed to penetrate through upper and lower surfaces thereof, and introducing the fuel thereinto; and an impeller 200 provided between the upper casing 100 and the lower casing 300, having a disk shape, and including a plurality of blades 230 formed along an outer circumferential surface in an outer direction of the outer circumferential surface and blade chambers 240 each formed between the blades 230 so as to penetrate through upper and lower surfaces thereof to allow the fuel to be discharged and introduced in upper and lower parts of the blades 230, respectively, wherein the upper casing 100 includes an upper inner channel 140 formed to be spaced apart from a shaft penetration hole 130 formed at the center thereof by a predetermined distance and penetrate through the upper and lower surfaces thereof, the impeller 200 includes an impeller channel 260 formed to be spaced apart from a shaft fixation hole 220 formed at the center thereof by a predetermined distance and penetrate through the upper and lower surfaces thereof, and the lower casing 300 includes a lower inner channel 340 formed at the center of the upper surface thereof and a lower connection groove 350 connecting the lower inner channel 340 and the lower channel groove 320 to each other, such that a separate channel is formed so that the fuel suctioned into the fuel suction port 310 flows along the lower channel groove 320 by rotation of the impeller 200, is introduced into the lower inner channel 340 through the lower connection groove 350, and passes through the impeller channel 260 to be discharged through the upper inner channel 140.

Hereinafter, the respective components will be described in more detail with reference to the accompanying drawings.

Figure 5:
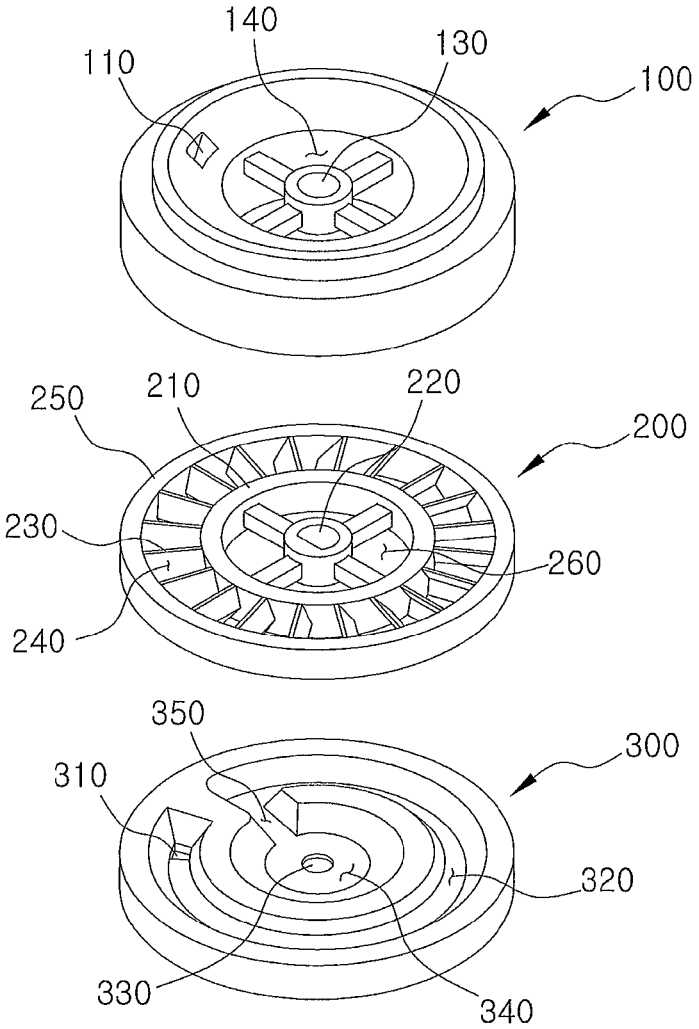
FIG. 5 is a partial exploded perspective view illustrating a turbine fuel pump for a vehicle according to an exemplary embodiment.

FIG. 5 is a partial exploded perspective view illustrating a turbine fuel pump for a vehicle according to an exemplary embodiment.

As shown in FIG. 5, in the turbine fuel pump 1000 for a vehicle according to the exemplary embodiment, an upper casing 100 and a lower casing 300 are joined to a lower end part of a motor housing 60 constituting the fuel pump and an impeller 200 is interposed therebetween.

In this case, the impeller 200 is configured to rotate in contact with the lower surface of the upper casing 100 and the upper surface of the lower casing 300, and a rotational shaft 21 of a motor 2 is joined to the impeller while penetrating through a shaft penetration hole 130 formed at the center of the upper casing 100 and penetrating through a shaft fixation hole 220 formed at the center of an impeller body 210 of the impeller 200, such that the impeller 200 rotates in accordance with rotation of the rotational shaft 21 of the motor 20. In addition, a lower part of the rotational shaft 21 penetrating through the shaft fixation hole 220 of the impeller body 210 is inserted into a shaft support groove 330 formed at the center of the lower casing 300 and a lower end surface of the rotational shaft 21 contacts a ball 360 joined to the shaft support groove 330 and is supported by the ball 360.

Figure 6:
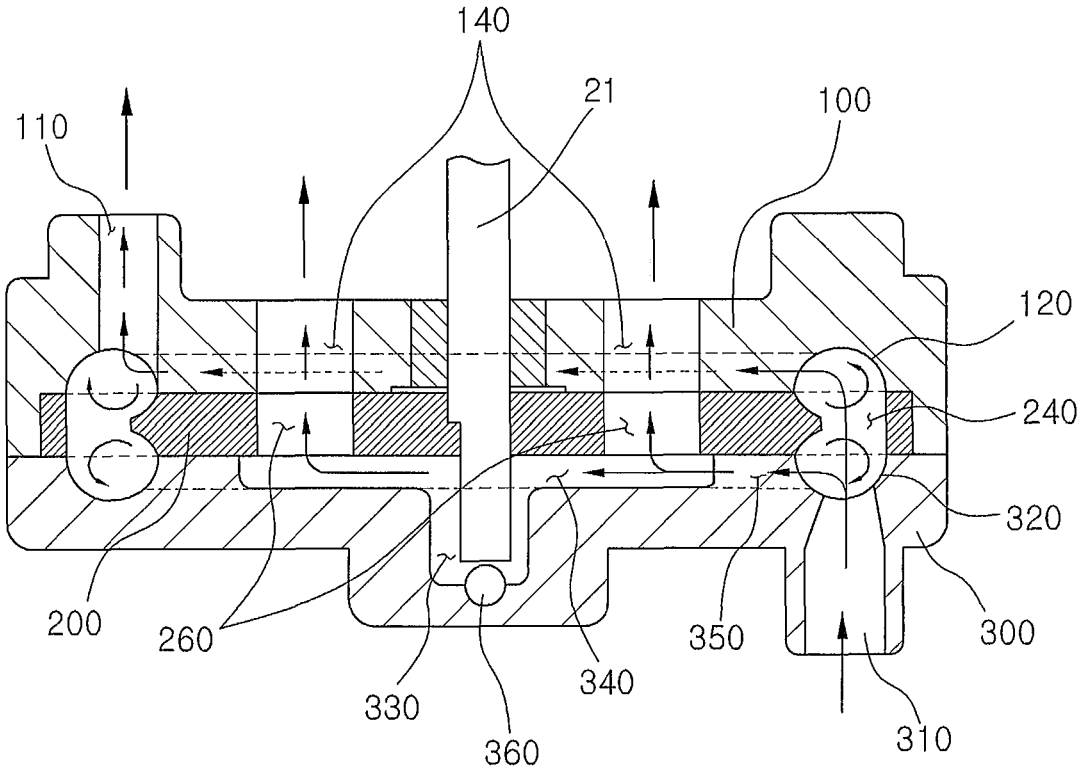
FIG. 6 is a cross-sectional view illustrating a flow of fuel in the turbine fuel pump according to the exemplary embodiment.

In addition, referring to FIGS. 5 and 6, the impeller 200 has a disk shape and includes a plurality of blades 230 formed along an outer circumferential surface in an outer direction of the outer circumferential surface, a side ring 250 formed on an outer surface of the plurality of blades 230, and blade chambers 240 each formed between the blades 230 so as to penetrate through upper and lower surfaces thereof to allow the fuel to be discharged and introduced in upper and lower parts of the blades 230, respectively.

Further, the lower casing 300 includes a lower channel groove 320 formed in an upper surface thereof so as to allow the fuel to flow therethrough and a fuel suction port 310 connected to the lower channel groove 320, formed to penetrate through upper and lower surfaces thereof and introducing the fuel thereinto, and the upper casing 100 includes an upper channel groove 120 formed in a lower surface thereof and having fuel flowing therethrough and a fuel discharge port 110 connected to the upper channel groove 120, formed to penetrate through upper and lower surfaces thereof, and discharging the fuel therethrough.

In this case, a start portion of the upper channel groove 120 is formed to be opposite to a start portion of the lower channel groove 320, and an end portion of the upper channel groove 120 is formed to be opposite to an end portion of the lower channel groove 320.

Therefore, as the impeller 200 rotates, a pressure difference is generated, such that fuel is suctioned into the fuel suction port 310 of the lower casing 300 and some of the fuel passes through the blade chamber 240 of the impeller 200 and flows along the upper channel groove 120 positioned in the upper part of the blade chamber 240 to be discharged through the fuel discharge port 110 and the rest of the fuel flows along the lower channel groove 320 positioned in the lower part of the blade chamber 240 and passes through the blade chamber 240 at the end portion of the lower channel groove 320 to be discharged through the fuel discharge port 110.

That is, the rotation flow is formed in each of the upper part and the lower part of the blade chamber 240 with the rotation of the impeller 200, such that the fuel suctioned into the fuel suction port 310 flows along each of the upper channel groove 120 and the lower channel groove 320 and passes through the blade chamber 240 of the impeller 200 at the end portion of the lower channel groove 320 to be joined and discharged in the fuel discharge port 110.

The turbine fuel pump for a vehicle that has the above structure and where fuel flows is called a side channel type and the fuel that flows along the lower channel groove 320 in the suctioned fuel is configured to be discharged through the fuel discharge port 110 only when it passes through the blade chamber 240 at the end portion of the lower channel groove 320.

Here, the upper casing 100 includes an upper inner channel 140 formed to be spaced apart from a shaft penetration hole 130 formed at the center thereof by a predetermined distance and penetrate through the upper and lower surfaces thereof, the impeller 200 includes an impeller channel 260 formed to be spaced apart from a shaft fixation hole 220 formed at the center thereof by a predetermined distance and penetrate through the upper and lower surfaces thereof, and the lower casing 300 includes a lower inner channel 340 formed at the center of the upper surface thereof and a lower connection groove 350 connecting the lower inner channel 340 and the lower channel groove 320 to each other Here, the respective channels 140, 260, and 340 are passages formed so that fuel may flow, and the lower connection groove 350 is a passage formed so that fuel flows by connecting the lower channel groove 320 and the lower inner channel 340 to each other.

Further, one side of the lower connection groove 350 is connected to the lower inner channel 340 and the other side of the lower connection groove 350 is connected to the lower channel groove 320, and one side of the lower connection groove 350 is connected to an opposite end of the lower channel groove 320 connected to the fuel suction port 310.

That is, the lower connection groove 350 is preferably formed so that the end portion of the lower channel groove 320 and the lower inner channel 340 are connected to each other.

In this case, the upper inner channel 140 is formed to be positioned between the shaft penetration hole 130 formed at the center of the upper casing 100 and the upper channel groove 120 formed outside the upper casing 100 and is formed so as not to be connected to the upper channel groove 120.

In addition, the impeller channel 260 is formed to be positioned between the shaft fixation hole 220 formed at the center of the impeller body 210 of the impeller 200 and the blade chamber 240 formed outside the impeller body 210 and formed so as not to be connected to the blade chamber 240.

Therefore, a separate channel is formed so that the fuel suctioned into the fuel suction port 310 flows along the lower channel groove 320 by rotation of the impeller 200, is introduced into the lower inner channel 340 through the lower connection groove 350, and passes through the impeller channel 260 to be discharged through the upper inner channel 140.

That is, as shown in FIG. 6, when the fuel is introduced into the fuel suction port 310 formed in the lower casing 300, some of the introduced fuel passes through the blade chamber 240 and flows along the upper channel groove 120 to be discharged through the fuel discharge port 110 of the upper casing 100 and the rest of the fuel flows along the lower channel groove 320 without passing through the blade chamber 240, is introduced into the lower inner channel 340 through the lower connection groove 350, and passes through the impeller channel 260 of the impeller 200 positioned in the upper part to be discharged through the upper inner channel 140.

Therefore, the fuel that flows along the lower channel groove 320 flows along the separate channel to be discharged without passing through the blade chamber 240 of the impeller 200 to reduce rotation resistance of the impeller 200 and damage of the rotation flow formed in the fuel that flows along the lower channel groove 320, thereby making it possible to reduce pressure instability of the fuel pump and increase efficiency.

As set forth above, according to the exemplary embodiment of the present invention, pressure instability can be solved by reducing flow resistance caused due to collision of fuel by allowing fuel to pass through the separate channel without passing through the impeller blade by forming the separate independent channel in the lower casing, the impeller, and the upper casing where channels of fuel are formed.

Further, damage of a fuel rotation flow caused by the impeller decreases to improve efficiency of a fuel pump.

The present invention is not limited to the aforementioned exemplary embodiment and an application range is various and it is apparent that various modifications can be made to those skilled in the art without departing from the spirit of the present invention described in the appended claims.

What is claimed is:

1. A turbine fuel pump for a vehicle, comprising:

an upper casing including an upper channel groove formed in a lower surface thereof so as to allow fuel to flow therethrough and a fuel discharge port connected to the upper channel groove, formed to penetrate through upper and lower surfaces thereof, and discharging the fuel therethrough;

a lower casing joined to a lower part of the upper casing and including a lower channel groove formed in an upper surface thereof so as to allow the fuel to flow therethrough and a fuel suction port connected to the lower channel groove, formed to penetrate through upper and lower surfaces thereof, and introducing the fuel thereinto; and an impeller provided between the upper casing and the lower casing, having a disk shape, and including a plurality of blades formed along an outer circumferential surface in an outer direction of the outer circumferential surface and blade chambers each formed between the blades so as to penetrate through upper and lower surfaces thereof to allow the fuel to be discharged and introduced in upper and lower parts of the blades, respectively, wherein the upper casing includes an upper inner channel formed to be spaced apart from a shaft penetration hole formed at the center thereof by a predetermined distance and penetrating through the upper and lower surfaces thereof, the impeller includes an impeller channel formed to be spaced apart from a shaft fixation hole formed at the center thereof by a predetermined distance and penetrating through the upper and lower surfaces thereof, and the lower casing includes a lower inner channel formed at the center of the upper surface thereof and a lower connection groove connecting the lower inner channel and the lower channel groove to each other, such that a separate channel is formed so that the fuel suctioned into the fuel suction port flows along the lower channel groove by rotation of the impeller, is introduced into the lower inner channel through the lower connection groove, and passes through the impeller channel to be discharged through the upper inner channel.

2. The turbine fuel pump for a vehicle of claim 1, wherein one side of the lower connection groove is connected to the lower inner channel and the other side thereof is connected to the lower channel groove, and one side of the lower connection groove is connected to an opposite end of the lower channel groove connected to the fuel suction port.

* * * * *